US006036230A

United States Patent [19]

Fārber

[11] Patent Number: 6,036,230

[45] **Date of Patent: *Mar. 14, 2000**

[54] PAPER, ESPECIALLY SECURITY PAPER

[75] Inventor: Wolfgang Fārber, Vienna, Austria

[73] Assignee: Oesterreichische National Bank, Vienna, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 08/628,678

[22] PCT Filed: Oct. 11, 1994

[86] PCT No.: PCT/AT94/00148

§ 371 Date: May 8, 1996

§ 102(e) Date: May 8, 1996

[87] PCT Pub. No.: WO95/10419

PCT Pub. Date: Apr. 20, 1995

[51] Int. Cl.[7] ..... B42D 15/00

[52] U.S. Cl. ..... 283/58; 283/109

[58] Field of Search ..... 283/107–111, 91, 283/93, 94, 57–59, 75, 86, 901–902, 904; 428/915, 916

[56] References Cited

FOREIGN PATENT DOCUMENTS

| | | |
|---|---|---|
| 0 013 557 A3 | 7/1980 | European Pat. Off. . |
| 0 279 880 A1 | 8/1988 | European Pat. Off. . |
| 0 625 431 A1 | 11/1994 | European Pat. Off. . |
| 33 14 670 A1 | 11/1983 | Germany . |
| 39 06 695 A1 | 9/1989 | Germany . |
| 2 185 214 | 7/1987 | United Kingdom . |
| 2 204 532 | 11/1988 | United Kingdom . |
| WO 94/01291 | 1/1994 | WIPO . |

*Primary Examiner*—Willmon Fridie, Jr.
*Attorney, Agent, or Firm*—Herbert Dubno

[57] ABSTRACT

The invention relates to paper, in particular a sheet of paper, preferably security paper such as a bank note, check or the like, the paper (1) comprising at least one window (2) therethrough bridged by a transparent film (3), such as a plastics film or a transparent paper.

4 Claims, 2 Drawing Sheets

PAPER, ESPECIALLY SECURITY PAPER

CROSS REFERENCE TO RELATED APPLICATIONS

This application is a national stage of PCT/AT94/00148 filed Oct. 11, 1994 and based in turn upon Austrian application A 2044/93 of Oct. 11, 1993 under the International Convention.

FIELD OF THE INVENTION

My present invention relates to a paper, especially a paper sheet, preferably security paper, e.g. bank notes, checks or the like.

BACKGROUND OF THE INVENTION

Security documents can have a thread or strip as a security element which is embedded in the document (German open application 39 06 695). The security element can be comprised of a light-permeable synthetic resin foil which can have an opaque coating extending over the element with openings in the form of applied markings and patterns. In addition, the security element can contain regions of a coloring and/or luminescent substance coextensively provided in the recesses which can distinguish the marks and/or patterns under appropriate light conditions from the security document and from the opaque layer in a color-contrasting manner. As a consequence, the marks, patterns or the like are visible in translumination and can be read visually and/or by machine.

In the security paper field there are, however, also problems in that color-copying devices have increasingly higher quality of compositions of the copies so that, especially with fleeting consideration as is customary in business life, the copies can scarcely be distinguished from the original. Many attempts have been undertaken to develop processes which will make copying of security paper impossible or at least will supply copies which can be distinguished from the original conspicuously. It has thus been proposed (German open application 33 14 670) to coat on at least one part of the surface of a verifiable document, a material which, upon lighting with illumination light, will tend to meet light of a wavelength which is different from the wavelength of the illumination light.

If one places a document thus prepared in the illumination light of a copier and collects emission light with a detector, the latter can generate signals which can be evaluated to interrupt or interdict at least one of the steps required for the duplication of the original document in the copier. The preparation of the document can pose difficulties and the applied material can change or ablate so the security function is no longer fulfilled.

SUMMARY OF THE INVENTION

The invention indicates a way to avoid these drawbacks. It is proposed to provide the paper with at least one window which traverses the paper (sheet) and which is bridged by a clear foil, for example a plastic foil or a transparent paper. In tests for copying a paper as thus formed, there arises at the location at which the window is found, a blob which, in the case of a color copier, is colored and in the case of black/white copies, is dark, so that the paper can easily be recognized as a copy. The (perimetral) shape of the window can be optional, e.g. round, oval, polygonal or the like. The window shape can however also be a symbol for a paper characteristic, e.g. the value of the paper.

Preferably the foil or the transparent paper extends through the window and is embedded in the paper (sheet) outside the window perimeter. The clear foil or the transparent paper can also fill the window so that the surfaces are planar, i.e. even at the window contour are free from a step. A further feature of the paper of the invention is characterized in that the clear foil or the transparent paper spanning the window is fastened on the upper side and/or lower side of the paper.

The paper (security paper) can also be constructed as a sandwich comprised of a normal paper layer with cut-out window and a second layer formed from a foil or a transparent paper. The window bridging the foil or the window bridging paper can, in the window region, be provided with a preferably machine-readable imprint or with an applied additional security feature.

BRIEF DESCRIPTION OF THE DRAWINGS

The invention is described more fully in conjunction with the drawing. In the drawing.

SPECIFIC DESCRIPTION

Figure 1:
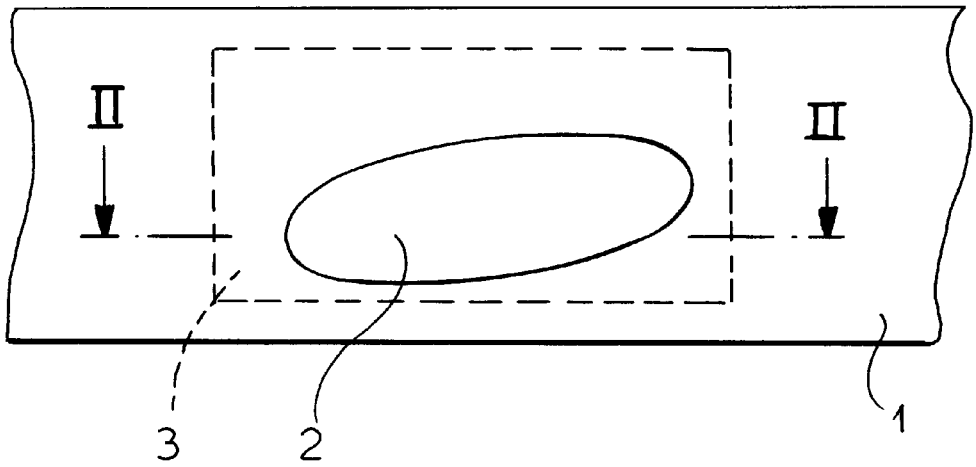
FIG. 1 is a plan view of a first embodiment of the paper of the invention.
Figure 2A:
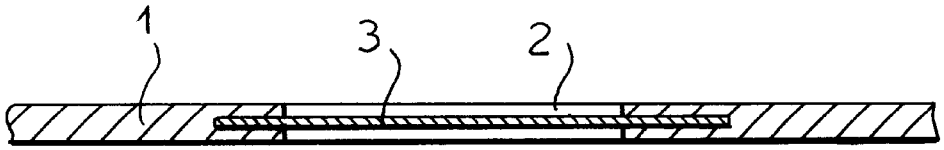
FIG. 2*a* is a section along the line II—II of FIG. 1.
Figure 2B:
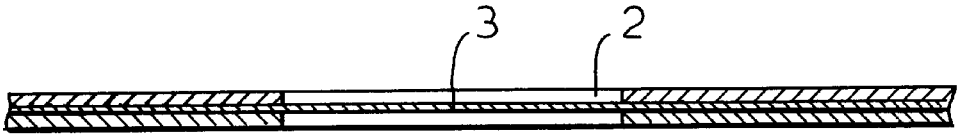
FIG. 2*b* is a cross sectional view showing the possibility of strip embedding or a sandwich structure of the security paper.

In FIGS. 1, 2*a* and 2*b* of the drawing, a paper sheet 1 and is provided with a window of an oval shape which traverses the paper. The window 2 is covered by a clear foil 3. Preferably this foil is comprised of plastic. Outside the window 2, the foil 3 of plastic or a layer of transparent paper is embedded in the paper 1 (FIGS. 2*a* and 2*b*.

Figure 3:
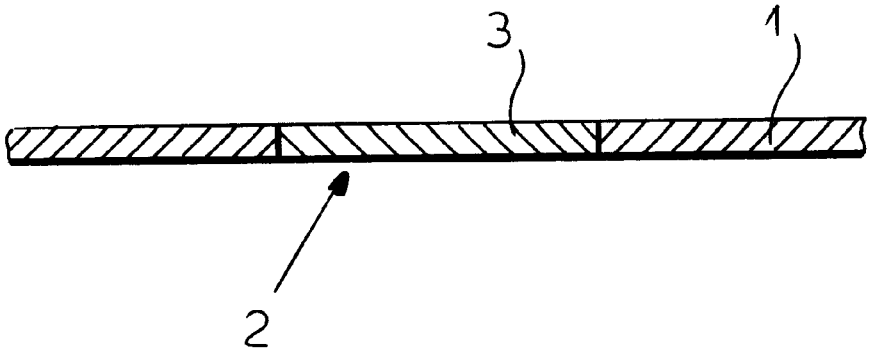
FIG. 3 is a section corresponding to FIG. 2*a*, but through an embodiment which is altered from the embodiments of FIGS. 1 and 2*a*, 2*b*.

In the embodiment according to FIG. 3, the clear foil 3 fills the window in the paper 1 (security paper) up so that in the region of the perimeter of the window 2, no step is formed but the paper remains planar over its total surfaces.

Figure 4:
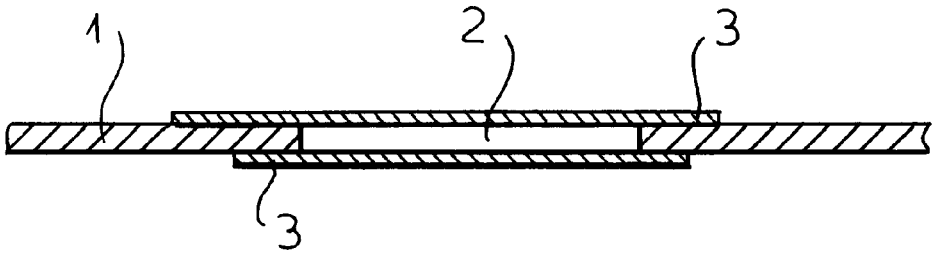
FIG. 4 is also a section corresponding to FIG. 1 but through an embodiment differing from the embodiment of FIGS. 1 and 2*a*, 2*b*.
Figure 5:
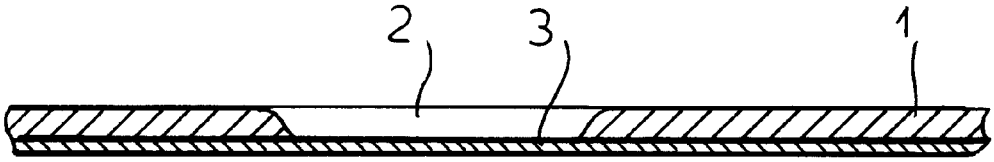
FIG. 5 is a section showing a construction of a normal paper layer in conjunction with a second transparent or clear foil layer or paper layer.

In the embodiment according to FIG. 4, the window 2 is covered at its upper surface as well as on its underside of the paper 1 by a respective foil 3 or a transparent paper that is fixedly bonded to the paper 1, e.g. by cementing. The foil 3 or the transparent paper can then extend over the entire surface of the paper, i.e. up to the paper edges. It is also possible to cover the window only on one side of the paper by a foil 3 or a layer of transparent paper. This foil or layer of transparent paper can then find itself either on the upper side or on the lower side of the paper (FIG. 5).

I claim:

1. A security paper in the form of a banknote, check or the like comprising a paper sheet formed with a window extending entirely through a thickness of the sheet and containing a one-piece clear transparent foil completely filling said window and flush with an upper side and an underside of the paper sheet.

2. The security paper defined in claim 1 wherein the foil is a transparent paper.

3. A security paper in the form of a banknote, check or the like comprising a paper sheet formed with a window extending entirely through a thickness of the sheet and having a closed perimeter, and a clear transparent foil bonded to said sheet on each outer surface thereof, bridged across said window and extending beyond said perimeter on each of said surfaces all around said window.

4. A security paper in the form of a banknote, check or the like comprising a paper sheet formed with a window extending entirely through a thickness of the sheet and having a closed perimeter, and a clear transparent foil completely filling said window and having surfaces contiguous with outer surfaces of said paper sheet all around a perimeter of said window.

* * * * *